United States Patent [19]

Fukuda et al.

[11] Patent Number: 4,908,941

[45] Date of Patent: Mar. 20, 1990

[54] METHOD AND APPARATUS FOR CONNECTING ELECTRICAL WIRES

[75] Inventors: Michio Fukuda; Fujio Ogawa, both of Yokkaichi, Japan

[73] Assignee: Sumitomo Wiring Systems, Ltd., Japan

[21] Appl. No.: 237,507

[22] Filed: Aug. 26, 1988

[30] Foreign Application Priority Data

Aug. 28, 1987 [JP] Japan ..... 62-131872

[51] Int. Cl.[4] ..... H01R 43/04

[52] U.S. Cl. ..... 29/857; 29/33 M; 29/564.8; 29/749

[58] Field of Search ..... 29/566.1, 566.3, 33 M, 29/748, 749, 753, 754, 760, 819, 854, 857, 564.1, 564.6, 564.8

[56] References Cited

U.S. PATENT DOCUMENTS

| | | | |
|---|---|---|---|
| 4,103,417 | 8/1978 | Hoffman et al. | 29/737 |
| 4,148,130 | 4/1979 | Stauffer et al. | 29/566.3 |
| 4,235,015 | 11/1980 | Funcik et al. | 29/857 |
| 4,367,575 | 1/1983 | Forster et al. | 29/33 M |
| 4,419,817 | 12/1983 | Funcik et al. | 29/857 X |
| 4,616,396 | 10/1986 | Matsui | 29/566.1 |
| 4,638,549 | 1/1987 | Okazaki et al. | 29/753 X |
| 4,674,819 | 6/1987 | Fujitani et al. | 439/404 |
| 4,682,391 | 7/1987 | Hall, Jr. et al. | 29/566.1 |

FOREIGN PATENT DOCUMENTS

| | | | |
|---|---|---|---|
| 2808056 | 8/1978 | Fed. Rep. of Germany | 29/753 |
| 226701 | 8/1985 | German Democratic Rep. | 29/749 |
| 1076628 | 7/1987 | United Kingdom . | |

*Primary Examiner*—William Briggs

*Attorney, Agent, or Firm*—Jordan B. Bierman

[57] ABSTRACT

A method and apparatus for connection of wires to a connector is disclosed. A means is provided for exerting a predetermined tension on the wires so that they are held in alignment while being pressed into the connector.

14 Claims, 3 Drawing Sheets

METHOD AND APPARATUS FOR CONNECTING ELECTRICAL WIRES

This Application claims the priority of Japanese Application 131,872/87, filed Aug. 28, 1987.

The present invention is directed to an improvement in devices and methods for connecting a plurality of wires; more specifically to a means for doing so which is particularly adapted for use in connecting motor vehicle wiring harness assemblies.

BACKGROUND OF THE INVENTION

The method and apparatus of the present invention are particularly useful in the preparation of wire connections when a plurality of connecting tabs are aligned in multiple linear arrays which are substantially parallel to each other. According to the present invention, reliable connection of the wires to their corresponding connecting tabs is achieved with a high degree of productivity.

U.S. Pat. No. 4,674,819 discloses device for forming branch circuits in a wire harness system. According to the invention, two groups of electric wires are connected by a plurality of tabs inserted through holes formed in a substrate of a junction box placed between the two groups of wires. The connection tab has a male electrical terminal portion at one end and at least one wire grip portion on the other end. This end has a U-shaped blade for making electrical contact with the wire passing through it. When the male portions are aligned at a suitable distance, the male portions are mated with corresponding female receptacles in the connector to which the first group of electric wires has been connected. On the opposite side of the substrate of the junction, the other end portions of the connection tabs are aligned so that each of their blades is capable of making an a direct electrical contact with at least one electric wire selected from the second group of electric wires passing through it.

British Patent No. 1,076,628 teaches a connector for use on cables in which a metallic tape is sandwiched between tapes of plastic material. The tape cable is laid in a channel of the bottom plate so that the portion of the cable at which the connections are to be made is close to the spring projections. The two mating members, which grip the tape cable therebetween, are fitted together and the top plate is laid over the bottom plate. When the two plates are pressed together, a tensioning means draws tape longitudinally between the mating clamping portions across the spring projection. Metallic teeth contact the insulation surface of the cable and further urging together of the top and bottom plates causes them to plough into the moving cable which is being pressed against the teeth by the spring projections. When the connector is in the fully mated configuration, the teeth have contacted the metallic conductor of the cable and the spring projections maintain forced electrical contact between them.

GENERAL DESCRIPTION OF THE PRESENT INVENTION

The present invention comprises a device for making electrical connections particularly for use with a plurality of insulated wires which are drawn along a predetermined path while the various operations are performed thereon. There is a clamping mechanism having a first position engaging the wires and a second position wherein the mechanism is out of engagement with the wires. The mechanism is adapted to move between the two positions.

There is a connecting means which is located downstream of the clamping means and is used to press the wires against appropriate electrical contacts which are adapted to receive them. There is also provided a head which is capable of moving downstream and upstream as required and a tensioning means is also provided to maintain a predetermined tension on the wires during the pressing operation.

In operation, the head is moved to a position upstream of the clamping mechanism. The wires are then affixed thereto and the head moved downstream past the clamping means and the connecting means to an end position. The clamping means is then activated and the tensioning means exerts a predetermined tension on the wires. At this time, the connecting means is also actuated and pressure is exerted on the wires to force them against the electrical contacts located in the connecting means.

DETAILED DESCRIPTION OF THE INVENTION

Figure 4:
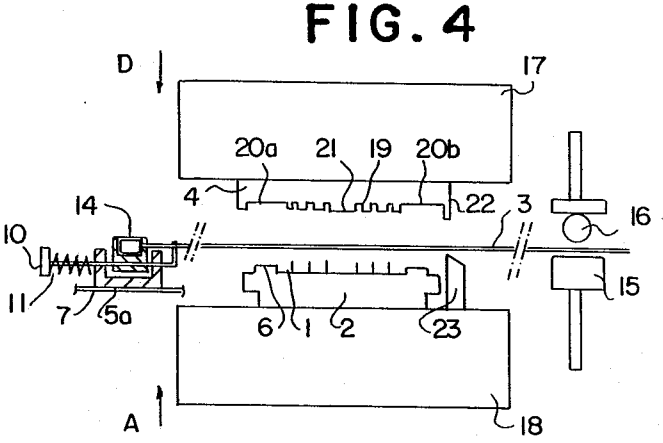
FIG. 4 is a cross-sectional view of the connecting means as shown in FIG. 1 in the open position.

The device of the present invention comprises moving head 25, aligning means 26, connecting means 27, and clamping mechanism 24. Wires 3 are acted upon by each of these elements to produce the finished product.

Moving head 25 is in association with a pair of carrier belts 5*a* and 5*b* upon which is mounted embracer 7. Embracer 7 is provided with a recess for receiving connector holder 8 to carrying clamp 14 which wires 3 are attached. Rods 9*a* and 9*b* pass slidably through the sides of embracer 7 and are fixed to connector holder 8. Springs 11*a* and 11*b* are mounted between the downstream side of embracer 7 and abutments 10*a* and 10*b*. Aligning means 26, in the form of separator 12, is mounted on the upstream ends of rods 9*a* and 9*b*. Aligning means 26 comprises a comb-like plate having spaced apart slots therein. It is mounted transversely to the direction of movement of wires 3; each of wires 3 passes through a single slot thereof.

Connecting means 27 comprises pressure plate 17 and table 18. These elements are adapted for motion in direction D to engage or disengage wires 3. On Table 18 is mounted junction device 2 which carries connector tabs 1 thereon. Presser 4 is affixed to pressure plate 17 and, on its surface facing junction device 2, has projections 21 and grooves 19. These are complementary to connecting tabs 1 on junction device 2.

Clamping mechanism 24 consists of pinching roller 16 and wire holder 15. As in the case of connecting means 27, these two elements are movable toward and away from each other. Preferably, roller 16 is covered with a resilient material in order to accept different sizes of wire and to exert its clamping action thereon.

Figure 1:
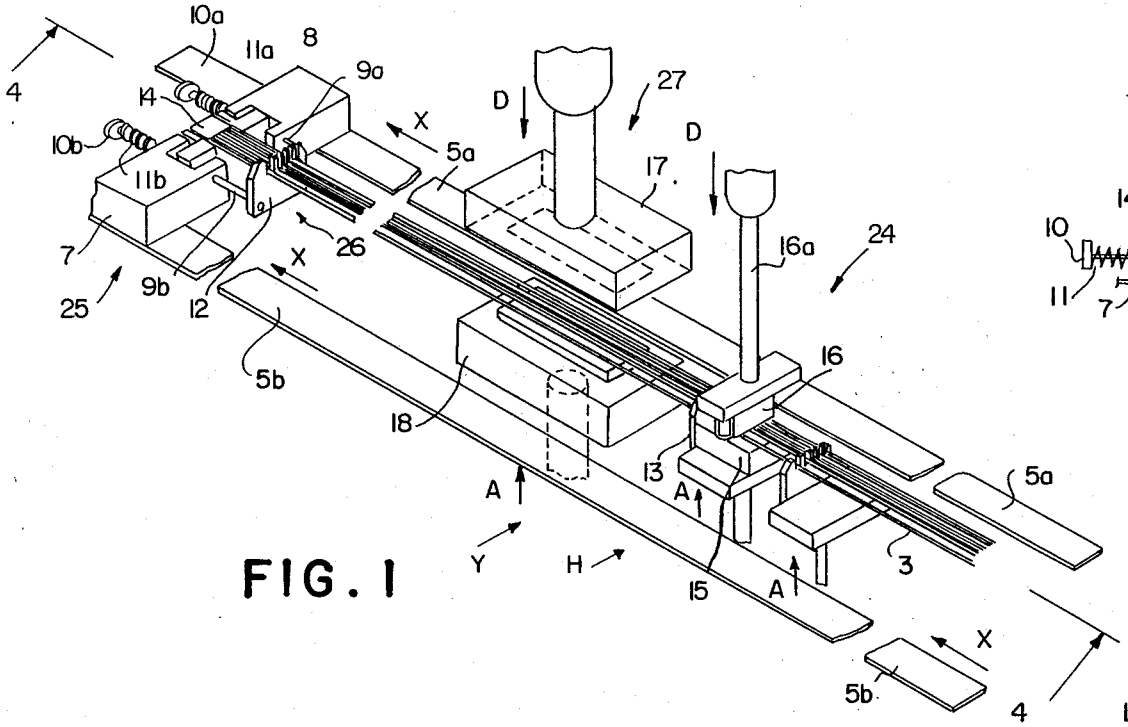
FIG. 1 is a schematic perspective view illustrating the device of the present invention and its method of use.
Figure 2:
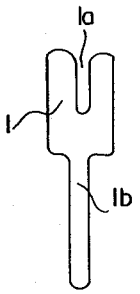
FIG. 2 shows a conventional wire connector having a U-shaped slot and a male terminal.
Figure 8:
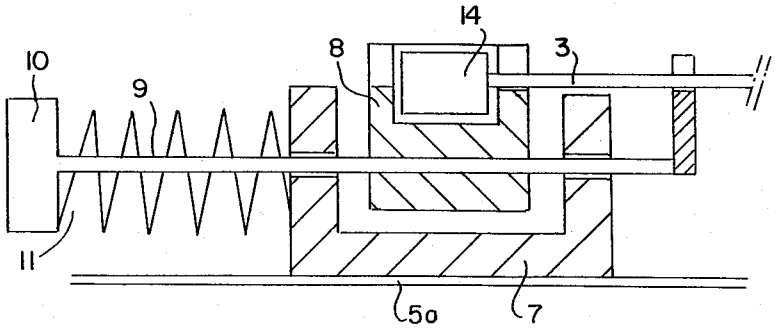
FIG. 8 is an enlarged view of the moving head, partly schematic and partly in section.

In operation, head 7 is brought to the upstream side of clamping mechanism 24. Wires 3 are attached to clamp 14 which is then locked onto connector holder 8. Holder 8 is placed in the recess in embracer 7. Both clamping mechanism 24 and connecting means 27 are in their open positions. The carrier drive (not shown) is activated and head 25 is moved in direction X as shown in FIG. 1. At approximately the point at which head 25 reaches the position as shown in FIG. 1, clamping mechanism 24 is actuated so that pinching roller 16 and wire holder 15 contact wires 3. Since the recess in embracer 7 is larger in the upstream-downstream direction than is connector holder 8, it can assume a position intermediate the upstream and downstream walls of the recess. This compresses springs 10*a* and 10*b*, exerting a predetermined tension on wires 3 between clamp 14 and clamping mechanism 24.

Figure 5:
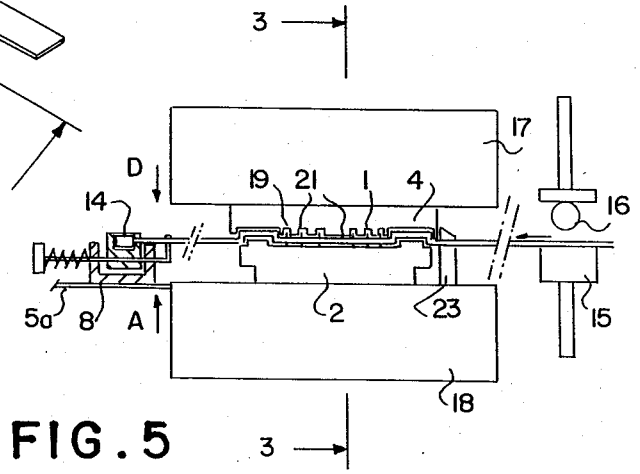
FIG. 5 is a cross-sectional view similar to that of FIG. 4, showing the mechanism in its closed position.
Figure 3:
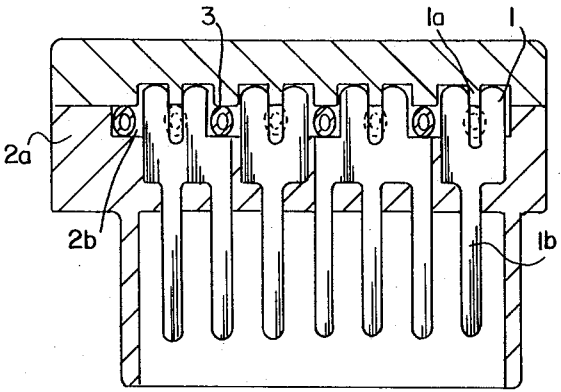
FIG. 3 is a cross-sectional view along line 3—3 of FIG. 5.
Figure 6:
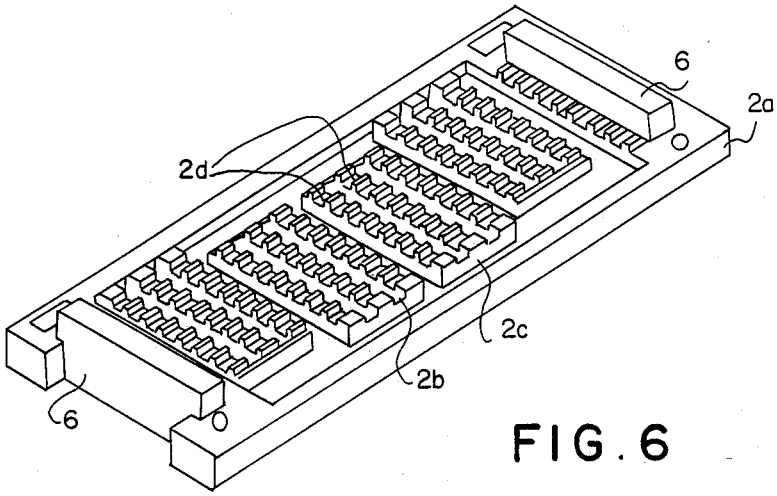
FIG. 6 is a perspective view of the frame of the junction device of the present invention.
Figure 7:
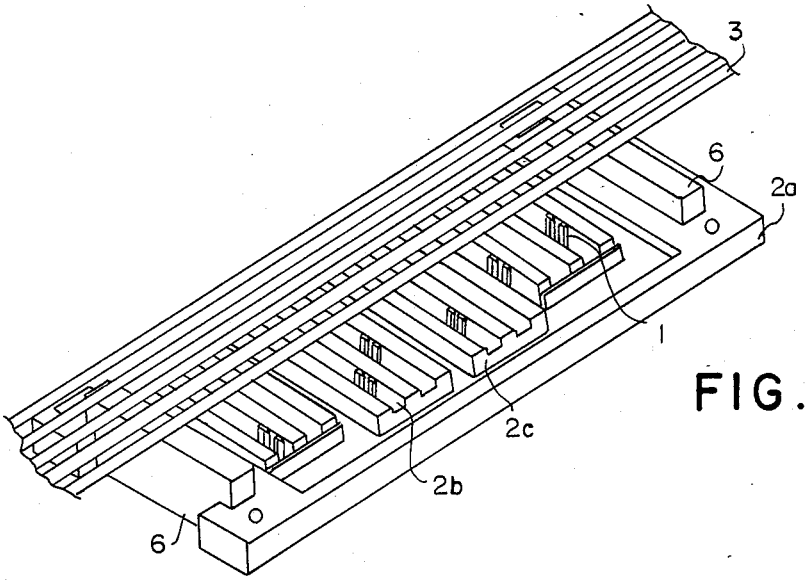
FIG. 7 is a view similar to that of FIG. 6 showing the relationship between the junction device and the wires.

At this point, connecting means 27 is actuated so that pressure plate 17 and Table 18 move towards each other to engage wires 3. More specifically, presser 4 receives holding blocks 6 in mating platforms 20*a* and 20*b*. This position is best shown in FIG. 5. Due to the configuration of the connecting means, projections 21 bear against wires 3 and force them into slots 1*a* in connection tabs 1. Moreover, grooves 19 are adapted to receive the blades forming slot 1*a* which project above receiving plate 2. This is best shown in FIG. 3. Thus, mating platforms 20*a* and 20*b* in cooperation with holding blocks 6 allow projections 21 to force wires 3 into slot 1*a*, but prevent any excessive force or damage to either the wires 3 or the blades.

It is a feature of the present invention that, when clamping mechanism 24 grips wires 3, outer cutter blade 23 meets inner cutter blade 22 to sever wires 3 immediately adjacent presser 4 and junction device 2. This is of particular advantage in automobile harnesses where the excess wire should be trimmed as closely as possible.

It can be seen that the present device and method provide a means for exerting a predetermined tension on the wires so that they are held in alignment without stretching or elongation and are not left so loose as to be permitted to tangle. This is of particular value in situations in which the wires used are extremely small and located very close together. Thus, the present invention permits the maintenance of the wires in excellent parallel alignment and allows the production of reliable connections between the wires and the appropriate tabs.

While only a limited number of specific embodiments of the present invention have been expressly disclosed, it is, nonetheless, to be broadly construed and not to be limited except by the character of the claims appended hereto.

I claim:

1. A device for making electrical connections with a plurality of wires which are coated with insulation and adapted to move in a downstream direction which comprises a clamping mechanism having a first position engaging said wires and a second position out of engagement with said wires, said mechanism adapted to move between said first and second positions, a connecting means, downstream of said clamping means, adapted to push said wires into electrical contacts adapted to receive said wires and thereby make electrical contact therewith, a movable head to which said wires are attached, means for attaching said wires to said movable head, means to guide said head for movement in said downstream direction and in an upstream direction opposite to said downstream direction, tensioning means, associated with said movable head, adapted to maintain a predetermined tension on said wires when said clamping mechanism is in said first position.

2. The device of claim 1 wherein said movable head comprises a holder to which said wires are attached and a carrier for said holder, said carrier engaged by a drive mechanism capable of moving said carrier in said upstream and said downstream direction.

3. The device of claim 1 wherein said holder is adapted for movement in said upstream and downstream directions relative to said carrier, said tensioning means comprising at least one spring urging said holder in said downstream direction.

4. The device of claim 3 wherein said holder is in a cavity in said carrier, at least one rod affixed to said holder and extending slidably through said carrier in said downstream direction, an abutment on a downstream end of said rod, and said spring is mounted between said carrier and said abutment, whereby said predetermined tension is maintained.

5. The device of claim 4 wherein said rod extends slidably through said carrier in said upstream direction and an aligning means for said wires is mounted on an upstream end of said rod.

6. The device of claim 5 wherein said aligning means comprises a plurality of spaced apart slots through which each of said wires passes.

7. The device of claim 1 wherein said connecting means comprises a junction device and a presser, said junction device having a plurality of contact tabs having outer portions extending out of said device away from said presser, and inner portions extending out of said device toward said presser, said inner portions having means for penetrating said insulation, said presser having projections for pressing said wires into electrical contact with said inner portions and having openings adapted to receive said inner portions.

8. The device of claim 1 wherein said mechanism comprises a roller and a retainer, said wires being therebetween, said roller and said retainer being movable toward and away from each other into a contact position abutting said wires and a non-contact position spaced apart from said wires.

9. The device of claim 8 wherein said roller is covered with a layer of resilient material.

10. The device of claim 8 wherein an aligning means is mounted of said retainer, said aligning means comprising a plurality of spaced apart slots through which each of said wires passes when said mechanism is in said contact position.

11. The device of claim 7 wherein there is at least one holding block on said plate and at least one complementary mating platform on said presser, whereby said plate and said presser are prevented from coming closer to each other than a predetermined distance.

12. A method of making electrical connections comprising affixing a plurality of wires to a head, moving said head in a downstream direction to an end point, thereby carrying said wires between portions of a clamping means and portions of a connecting means, clamping said wires upstream of said connecting means, exerting tension on said wires in said downstream direction at a tension point downstream of said connecting means and, while under said tension, pressing said wires into electrical contact with a plurality of contacts adapted to receive said wires.

13. The method of claim 12 wherein said wires are placed in grooves on a junction device in said connecting means.

14. The device of claim 7 wherein cutting means is provided on said presser and said device at upstream ends thereof.

* * * * *